US011525616B2

(12) United States Patent
Wilkerson et al.

(10) Patent No.: US 11,525,616 B2
(45) Date of Patent: Dec. 13, 2022

(54) MULTI-POSITIONAL PORTABLE COOLER SYSTEM AND METHOD

(71) Applicants: Larry James Wilkerson, Steamboat Rock, IA (US); Nicholas Wilkerson, Steamboat Rock, IA (US)

(72) Inventors: Larry James Wilkerson, Steamboat Rock, IA (US); Nicholas Wilkerson, Steamboat Rock, IA (US)

( * ) Notice: Subject to any disclaimer, the term of this patent is extended or adjusted under 35 U.S.C. 154(b) by 493 days.

(21) Appl. No.: 16/777,376

(22) Filed: Jan. 30, 2020

(65) Prior Publication Data

US 2020/0300534 A1 Sep. 24, 2020

Related U.S. Application Data

(60) Provisional application No. 62/822,953, filed on Mar. 24, 2019.

(51) Int. Cl.
*F25D 3/08* (2006.01)
*F25D 25/02* (2006.01)

(52) U.S. Cl.
CPC ..... *F25D 3/08* (2013.01); *F25D 25/025* (2013.01); *F25D 2303/0821* (2013.01); *F25D 2303/0845* (2013.01); *F25D 2331/805* (2013.01); *F25D 2700/12* (2013.01)

(58) Field of Classification Search
CPC ..... F25D 3/08; F25D 25/025; B65D 21/0233
USPC ..... 312/334.7, 348.4, 348.6, 402, 401; 220/592.16, 23.88, 23.87, 23.83; 62/382, 62/457.5, 457.4, 457.2, 457.1
See application file for complete search history.

(56) References Cited

U.S. PATENT DOCUMENTS 4,266,407 A 5/1981 Gibson
4,841,661 A * 6/1989 Moore ..... A01K 97/06 222/130
4,899,904 A * 2/1990 Dooley ..... F25D 3/08 220/592.2
5,095,718 A * 3/1992 Ormond ..... F25D 3/08 206/427
5,400,610 A 3/1995 Macedo
5,605,056 A 2/1997 Brown et al.
5,816,433 A 10/1998 Higgins
5,864,981 A * 2/1999 Zeman ..... A01K 97/22 206/315.11
5,890,613 A * 4/1999 Williams ..... A45C 7/0045 220/23.4
6,182,462 B1 2/2001 Bania et al.
6,253,570 B1 7/2001 Lustig
6,357,252 B1 3/2002 Rand
6,997,007 B1 2/2006 Wyatt
7,147,125 B1 12/2006 Slovak et al.
7,380,410 B2 * 6/2008 Rand ..... F25D 23/021 312/301
7,415,794 B1 * 8/2008 Thompson ..... A01K 97/22 206/315.11
7,984,997 B1 7/2011 Sandberg
(Continued)

*Primary Examiner* — Robert J Hicks
(74) *Attorney, Agent, or Firm* — Fish & Richardson P.C.

(57) ABSTRACT

An improved portable cooler can be configured to provide access to its contents from multiple orientations while reducing the likelihood of water spillage or contamination. The improved portable cooler may optionally include one or more sliding compartments to allow access to the contents of the portable cooler when the cooler is arranged in any of a horizontal or vertical orientation.

19 Claims, 9 Drawing Sheets

(56) References Cited

U.S. PATENT DOCUMENTS

| | | | | |
|---|---|---|---|---|
| 8,152,367 | B2 | 4/2012 | Roberts et al. | |
| 8,256,156 | B1 * | 9/2012 | Burgoyne, Jr. ..... | A45C 5/065 280/7.14 |
| 8,733,577 | B2 | 5/2014 | Patterson | |
| 10,082,329 | B1 | 9/2018 | Sandberg et al. | |
| 10,088,144 | B1 | 10/2018 | Sandberg | |
| 2004/0026946 | A1 * | 2/2004 | Reed, III ..... | B60P 3/0257 296/24.3 |
| 2005/0145635 | A1 | 7/2005 | Slovak et al. | |
| 2006/0279947 | A1 | 12/2006 | Henley, Jr. et al. | |
| 2006/0288730 | A1 | 12/2006 | Shill | |
| 2008/0245095 | A1 | 10/2008 | Schlipman et al. | |

* cited by examiner

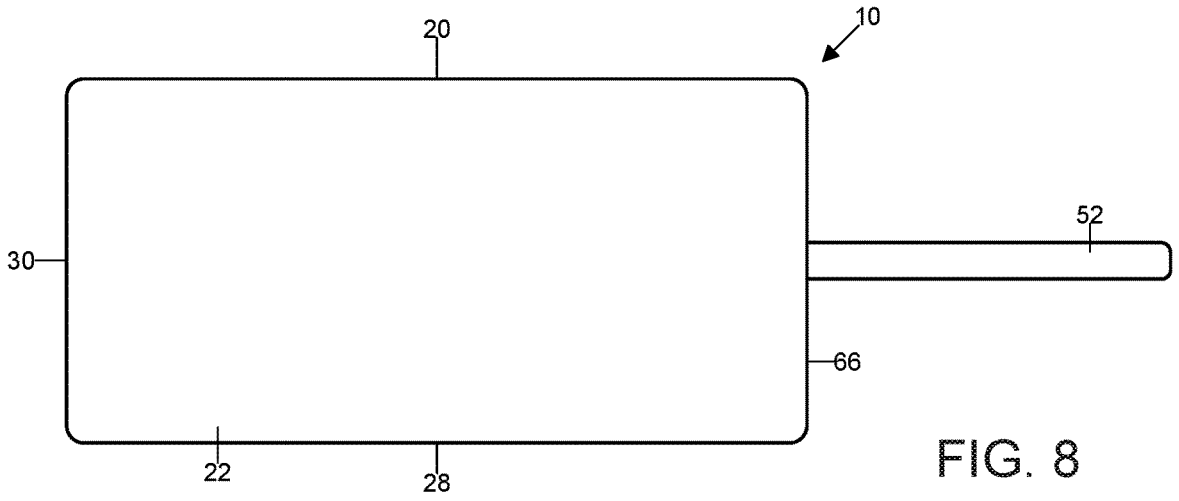
FIG. 8
FIG. 9
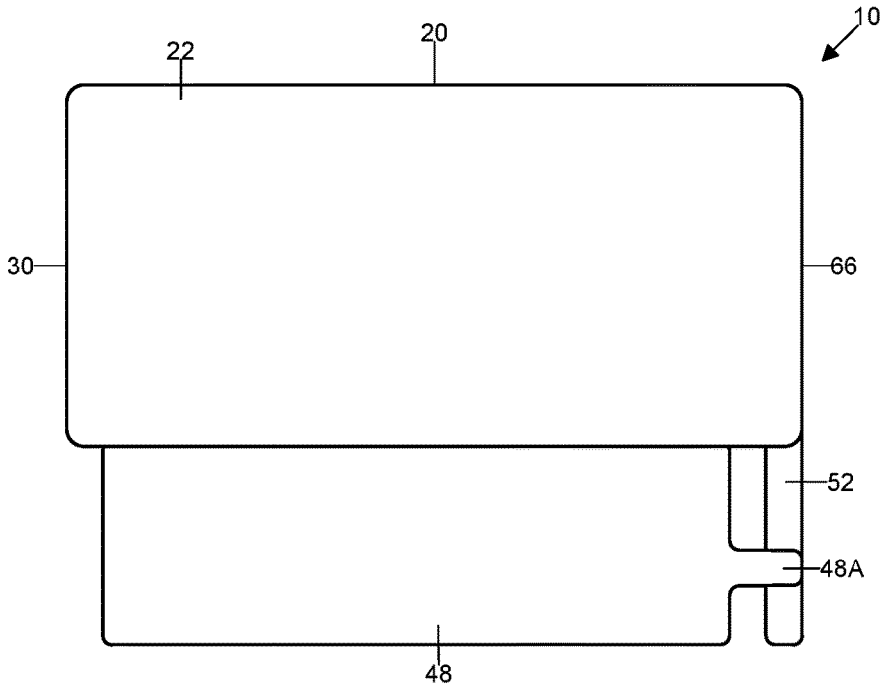

MULTI-POSITIONAL PORTABLE COOLER SYSTEM AND METHOD

CROSS-REFERENCE TO RELATED APPLICATION(S)

This application claims the benefit of U.S. provisional application Ser. No. 62/822,953 filed Mar. 24, 2019. The disclosure of the prior application is considered part of (and is incorporated by reference in) the disclosure of this application.

TECHNICAL FIELD

This disclosure relates to a cooler system, and more particularly to a portable insulated cooler, its method of manufacture, and its method of use.

BACKGROUND

Portable coolers are convenient for keeping beverages or food items cold while traveling or being outdoors for extended periods of time or taking road trips and vacations. Traditional portable coolers are typically insulated, and designed with a hinged top or lid. Such portable coolers are typically filled with ice or frozen, reusable cooler packs mixed amongst the beverages or food items in order to keep the food or beverages cold. In many cases, the portable cooler must be maintained in an upright orientation during use (so that the hinged top or lid is oriented upward) to prevent spillage of water from melting ice.

For example, when packing for trips or other events like picnics, careful consideration must be taken as to the orientation of the cooler and its position relative to other luggage or items in order to avoid spillage of ice or water. Likewise, the cooler must typically be placed on an even or near-even surface during use to prevent spillage. As a result, particularly during travel, items may be placed on top of, or in very close proximity to the cooler.

SUMMARY

Some embodiments described herein include an improved portable cooler that allows for convenient access to its contents from multiple orientations while reducing the likelihood of water spillage or contamination. For example, the improved portable cooler may optionally include one or more sliding compartments to allow convenient access to the contents of the portable cooler whether the unit is in a horizontal, vertical, or other orientation. Various embodiments may include food or beverage storage containers within the sliding compartments to prevent food or beverage from falling out of the cooler when the sliding compartments are opened in different orientations. Further, in some implementations, the cooler may include compartments for frozen cooler packs or other cooling media that allow for cooling of food or beverages without directly exposing such food or beverages to waste water or ice.

Optionally, the cooler may also comprise one or more viewing windows in the exterior wall(s) to provide viewability of the contents of the cooler even while the cooler remains in a closed condition. Certain embodiments may include at least one illumination device, which can comprise as one or more LED lights, to allow viewing the contents of the cooler in low-light situations. The portable cooler may also include an externally readable temperature display to allow for monitoring the coldness of the interior cavity of the cooler without having to open the unit. In particular implementations, the cooler may also comprise elevation panels to raise and lower the horizontal profile of the cooler and one or more handles to assist with transporting the cooler.

Particular embodiments described herein include a portable cooler that includes a cooler body at least partially defined by a front wall, a rear wall, two side walls, a bottom, and a lid. Optionally, the lid is a nonremovable lid. In such cases, the nonremovable lid may be rigidly fixed to the front wall, the rear wall, and the two side walls. The portable cooler may also include first and second drawer channels positioned side-by-side in the front wall. Each of the first and second drawer channels may optionally define respective guide rails that extend in a longitudinally rearward direction toward the rear wall. The portable cooler may further include a first cooler drawer configured to slidably engage with the guide rails of the first drawer channel, and a second cooler drawer configured to slidably engage with the guide rails of the second drawer channel. The portable cooler may also include a cooler compartment positioned within the cooler body for containing at least one cooling element in thermal communication with at least one of the first and second cooler drawers.

Some embodiments described herein include a method of cooling contents of a portable cooler. The method may include placing a first item to be cooled into a first cooler drawer of the portable cooler. The portable cooler may have a cooler body that is optionally defined by one or more of a front wall, a rear wall, two side walls, a bottom, and a lid. Optionally, the lid is a nonremovable lid, which may be rigidly fixed to the front wall, the rear wall, and the two side walls. The method may also include sliding the first cooler drawer into a first closed position in a first drawer aperture in the front wall. For example, the first cooler drawer may slide into the first closed position so that the first cooler drawer engages with a first set of guide rails extending in a longitudinally rearward direction away from the front wall and toward the rear wall contemporaneously while the nonremovable lid supports an external structure upon an upper face of the nonremovable lid. Optionally, the method may further include placing a second item to be cooled into a second cooler drawer of the portable cooler, and sliding the second cooler drawer into a second closed position in a second drawer aperture in the front wall. In such cases, the second cooler drawer may slide into the second closed position so that the second cooler drawer engages with a second set of guide rails extending in the longitudinally rearward direction away from the front wall and toward the rear wall contemporaneously while the nonremovable lid supports the external structure upon the upper face of the nonremovable lid. Preferably, the first and second set of guide rails extend substantially the entire distance from the front wall to the rear wall, for example, more than 90% the entire distance from the front wall to the rear wall. The first and second cooler drawers may be configured to slidably engage with substantially the entire length of the first and second sets of guide rails. In some optional embodiments, the first cooler drawers can slidably engage with the entirety of the length of the first set of guide rails, and the second cooler drawers can slidably engage with the entirety of the length of the second set of guide rails. The method may also include positioning the first item and the second item above at least one cooling element arranged within the cooler body, which may be optionally achieved contemporaneously while the nonremovable lid supports the external structure upon the upper face of the nonremovable lid.

In other embodiments described herein, a method includes supporting an external structure upon an upper face of a lid of a portable cooler. The portable cooler may include a cooler body at least partially defined by a front wall, a rear wall, two side walls, a bottom, and the lid. Optionally, the lid is a nonremovable lid. The method may also include providing access to a removable item stored in a first slidable cooler drawer of the portable cooler during the supporting of the external structure upon the upper face of the nonremovable lid. The first slideable cooler drawer may optionally be one of a pair of side-by-side slidable cooler drawers located above at least one cooling element within the cooler body. The step of providing access to the removable item may be achieved, at least in part, by withdrawing the first cooler drawer in a longitudinally forward direction away from the rear wall while the other of the slideable cooler drawers remains stationary relative to the rear wall.

A number of embodiments described herein may provide one or more of the following advantages. First, particular versions of the improved cooler are configured to provide convenient access to the internal cooler compartment(s) during transport or at other times, even when luggage or other external structures are placed on top of the cooler. In such circumstances, the improved cooler may be beneficially arranged in a variety of alternative orientations (while storing food, beverages, or other items to be cooled) while also reducing the likelihood of spillage of water or its contents.

Second, some embodiments of the improved cooler described below can be configured to isolate the food and beverage items (or other items) sought to be cooled away from the ice or cooling packs providing the cooling effect. As such, the cooler can advantageously reduce the likelihood of moistening or spoiling of the food/beverage/other items within the cooler that might otherwise result from melted ice during the use of the cooler. Additionally, for those embodiments in which reusable cooling packs are used to provide the cooling effect, the improved cooler can be configured to isolate the food/beverage/other items away from the reusable cooler packs so as to reduce the likelihood that the reusable cooling packs would be contaminated otherwise require additional cleaning before reuse.

Third, a number of embodiments of the improved cooler described herein can be configured for the user to more easily ascertain the amount of food or beverage remaining in the cooler, for example, by implementing the cooler design using one or more transparent viewing windows at selected locations.

Fourth, some version of the improved cooler may be equipped with lower elevation panels to raise the horizontal profile of the cooler, which may provide the benefit of simplified access to the interior compartment(s) of the cooler while the lower elevation panels rest on an otherwise lower flat surface.

The details of one or more embodiments are set forth in the accompanying drawings and the description below. Other features, objects, and advantages will be apparent from the description and drawings, and from the claims.

DESCRIPTION OF DRAWINGS

FIG. 8 shows a left side view of an embodiment of portable cooler 10 with carry handle 52 extended.

FIG. 9 illustrates a left side view of an embodiment of portable cooler 10 with carry handle carry handle 52 retracted and elevation panel 48 extended.

Like reference symbols in the various drawings indicate like elements.

DETAILED DESCRIPTION

Figure 1:
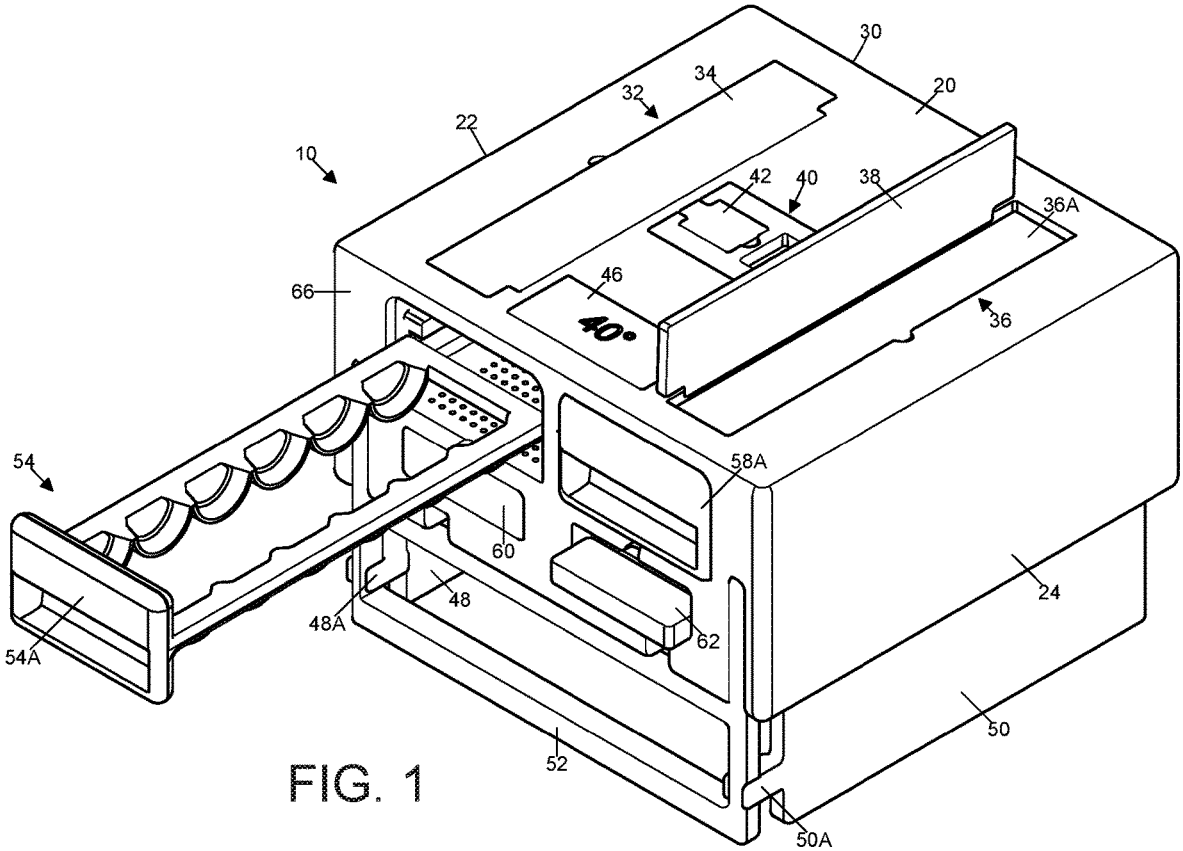
FIG. 1 shows an isometric view an embodiment of portable cooler 10.
Figure 2:
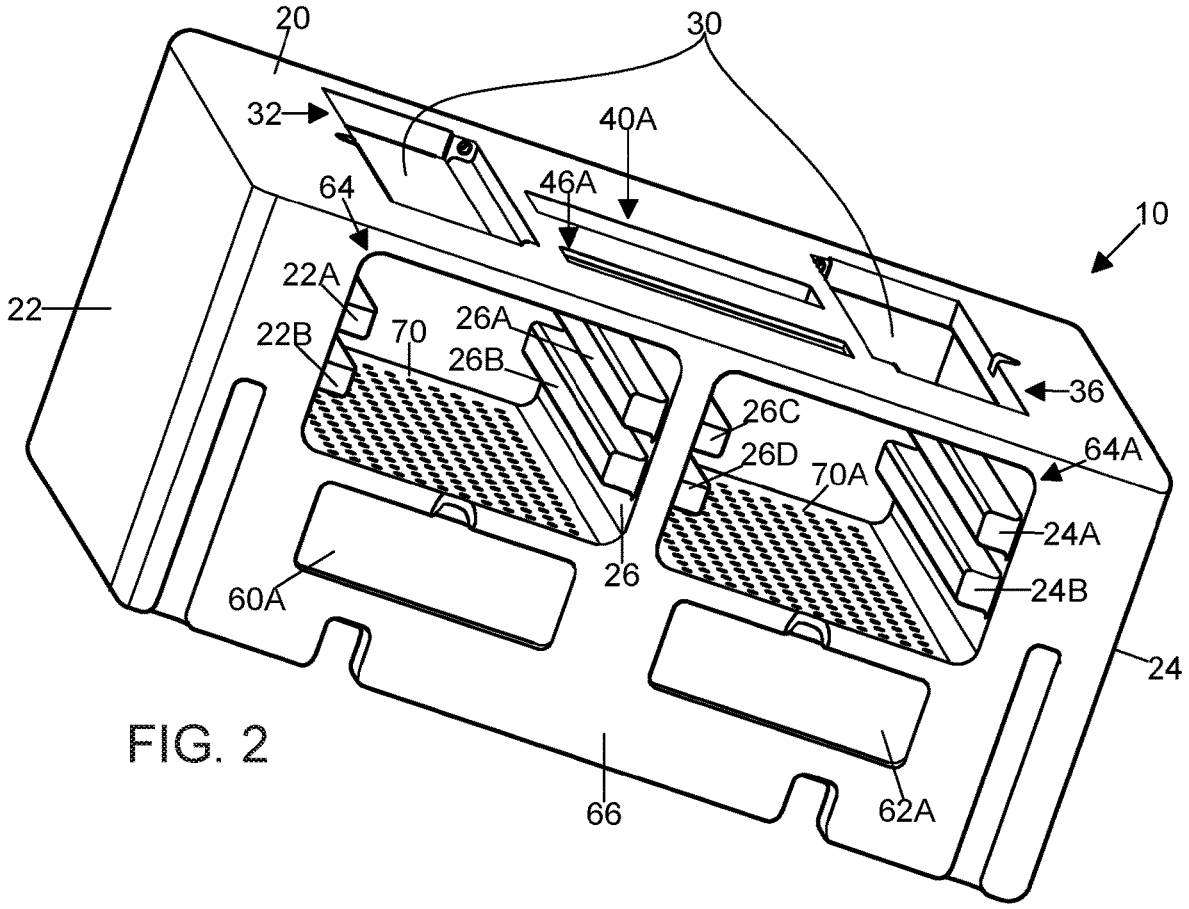
FIG. 2 shows an isometric view of the body and interior portion of an embodiment of portable cooler 10.

Referring now to FIGS. 1-2, some embodiments of a portable cooler 10 include slidable drawers 54 and 58 for storing food, beverages, or other items to be chilled (e.g., chilled contents). Slidable drawers 54 and 58 may slide relative to storage cavities 64 and 64A, respectively. As shown in FIG. 2, slidable drawer 54 may slide relative to storage cavity 64 by engaging with rails 22A, 22B, 26A, and 26B.

Slidable drawer 58 may slide relative to storage cavity 64A by engaging with rails 24A, 24B, 26C, and 26D. Portable cooler 10 may be comprise one or more polymer materials which can be formed, for example, using a molding process, such as rotational molding, injection molding, or blow molding. In certain embodiments, several components of portable cooler 10 may be formed as a unitary structure to provide manufacturing efficiencies and simplified construction. As shown in FIG. 1, slidable drawers 54 and 58 may include handles 54A and 58A, respectively.

The slidable drawers 54 and 58 may slide relative to side panels 22 and 24, and middle panel 26. In some embodiments, rails 22A, 22B, 26A, and 26B extend substantially the entire length of side panels 22 and 24, respectively. In these embodiments, slidable drawers 54 and 58 may also extend substantially the entire length of rails 22A, 22B, 26A, and 26B. In some embodiments, cooler compartments 60A and 62A are located entirely below slidable drawers 54 and 58. Additionally, in this embodiment, the cooler compartments 60A and 62A of the portable cooler 10 are sized and shaped to removably retain reusable cooler packs (sometime referred to as frozen cooler packs). For example, each cooler compartment 60A, 62A can define a cavity having a shape that is complementary to the exterior shape of a corresponding cooler pack. The cooler compartments 60A and 62A, as shown in FIG. 2, are defined in the lower portion of portable cooler 10. The location of the reusable cooler packs are thus in close proximity to, and positioned below, the lower portions of slidable drawers 54 and 58. Cooler compartments 60A and 62A are bounded by side panels 22 and 24, top panel 20, bottom panel 28 (not shown), front panel 66, and rear panel 30.

In some embodiments, top panel 20 is fixed to (and nonremovable from) front panel 66, rear panel 30, and side panels 22 and 24. For example, the top panel 20 rigidly fixed to the front panel 66, rear panel 30, and side panels 22 and 24 so that it is not hinged or otherwise removable from front panel 66, rear panel 30 and side panels 22 and 24. This allows for exterior items to be stored on top of portable cooler 10, but the contents of portable cooler 10 can be accessed while those items remain stored on the top panel (without needing to lift or remove the top panel 20).

Still referring to FIGS. 1-2, side panels 22 and 24, front panel 66, rear panel 30, top panel 20, and bottom panel 28 provide an insulation barrier for the contents of the portable cooler 10 from the ambient air. This allows for more efficient operation of portable cooler 10 and will extend the amount of time that a given cooling media may be used to cool portable cooler 10. Side panels 22 and 24, front panel 66, rear panel 30, top panel 20, and bottom panel 28 may be insulated in a number of ways, such as, for example, by providing an air or vacuum barrier between an inner and outer wall, or by injection of an inert gas between an inner and outer wall. In other embodiments, the materials of side panels 22 and 24, front panel 66, rear panel 30, top panel 20, and bottom panel 28 may be selected based on their insulative properties so as to provide improved insulation.

As shown in FIG. 1, cooler compartments 60A and 62A may be located behind cooler panels 60 and 62, respectively. As shown in FIG. 1, cooler panel 62 is open and cooler panel 60 is closed. Cooler panels 60 and 62 may be connected to front panel 66 by hinges or other attachment hardware, or may optionally be formed as a part of front panel 66. The cooler packs for cooler compartments 60A and 62A may be retained by a pack retainer, depending on the particular design of the cooler pack selected. In other embodiments, cooler compartments 60A and 62A may be combined into a single non-divided space or cavity located below slidable drawers 54 and 58. Further, in some embodiments, cooler compartments 60A and 62A may be separated from storage cavities 64 and 64A by cavity dividers 70 and 70A, respectively. In some embodiments, cavity dividers 70 and 70A may be perforated, while in others cavity dividers 70 and 70A may be solid, depending on the desired heat transfer properties between cooler compartments 60A, 62A and storage cavities 64, 64A.

Still referring to FIGS. 1-2, in some embodiments, a carry handle 52 may be pivotably mounted relative to the side panels 22, 24 of the portable cooler 10. For example, the carry handle 52 can be connected with one or more movable hinge brackets that pivot within respective hinge connector cavities. However, other connecting hardware may be used to connect carry handle 52 to side panels 22, 24. In this embodiment, the carry handle 52 extends from the movable hinge brackets and is adjustable between a first position (FIG. 1) in which it is retracted and a second position (FIG. 2) in which it is extended. In the retracted position, the left front portion of carry handle 52 may be fixed in position by handle lock 48A, and the right front portion of carry handle 52 may be fixed in position by handle lock 50A. Handle locks 48A, 50A, may be formed as a part of the front portions of elevation panels 48 and 50, respectively.

Figure 4:
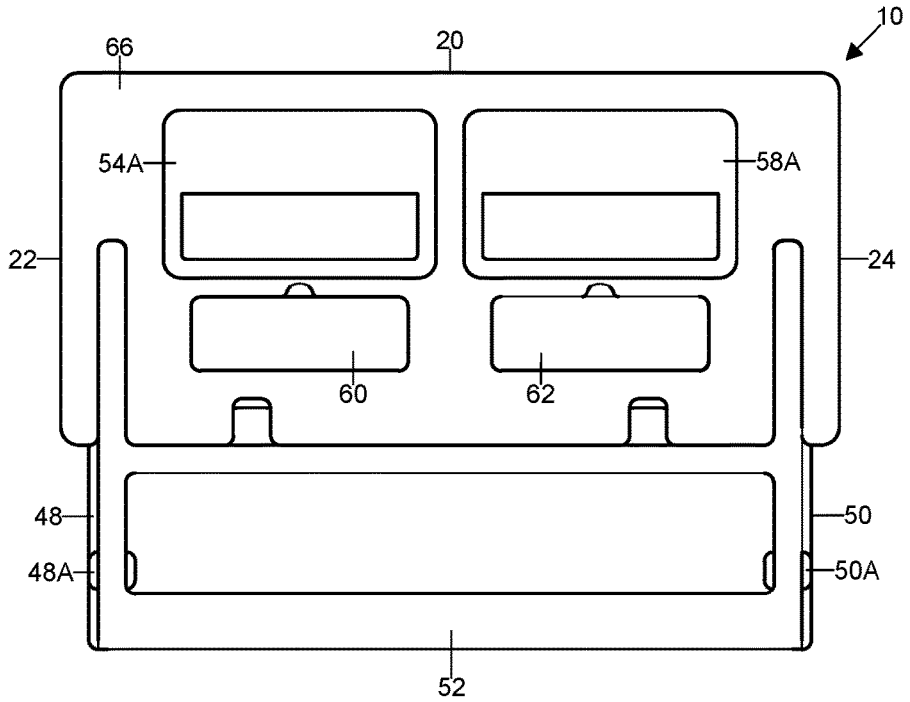
FIG. 4. depicts a front view of an embodiment of portable cooler 10 with carry handle 52 and elevation panels 48 and 50 extended.

As shown in FIG. 1, elevation panels 48 and 50 are in an extended position, engaging carry handle 52. In FIG. 2, elevation panels 48 and 50 are in a retracted or folded position. In certain embodiments, elevation panels 48 and 50 may rest in a recessed portion of bottom panel 28. The front and rear portions of elevation panels 48 and 50 may be pivotably connected to bottom panel 28. Conventional hinges or other suitable attachment hardware may be used. A user may extend elevation panels 48 and 50 when it is necessary to raise the lower portion of portable cooler 10 to avoid obstacles that may impede access to slidable drawers 54 and 58 or cooler compartments 60A and 62A. FIG. 4 shows an embodiment of portable cooler 10 where carry handle 52 is in a retracted position.

Referring again to FIGS. 1-2, in some embodiments, one or more viewing apertures may be defined by the top panel 20. For example, viewing apertures 32 and 36 may in some embodiments be fitted with aperture covers 34 and 38, which may be pivotably connected to top panel 20. Top panel 20 may also contain battery compartment 42. Layers 32A and 36A may be inserted into viewing apertures 32 and 36, respectively. In certain embodiments, layers 32A and 36A may be transparent so as to allow a user an external view into storage cavities 64 and 64A to view the content of either slidable drawers 54, 58 while portable cooler 10 is closed. Light module aperture 40A may be formed or cut for insertion of light module 40 to allow for additional light for viewing the interior of portable cooler 10. Temperature module aperture 46A may be cut or formed for insertion of temperature module 46.

Figure 3:
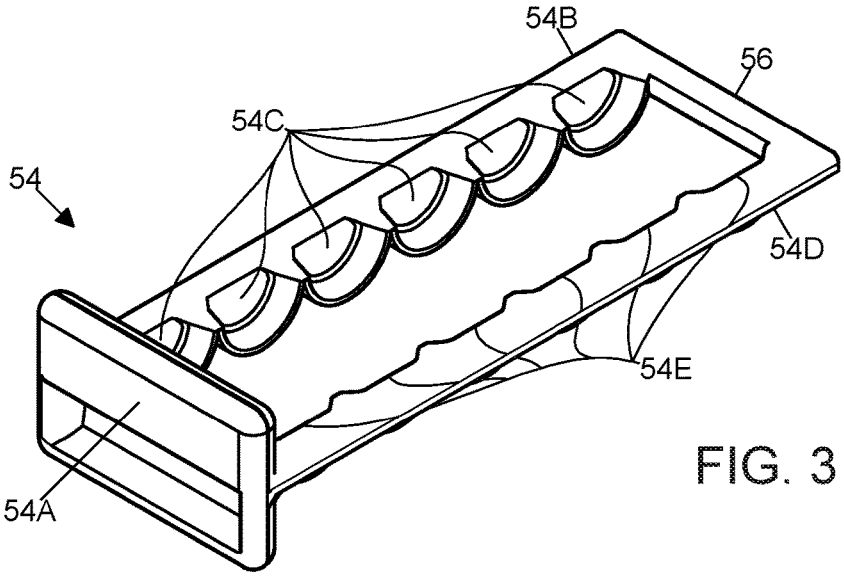
FIG. 3 illustrates an isometric view of slidable drawer 54.

Referring now to FIG. 3, some embodiments of the portable cooler 10 can include at least one slidable drawer 54, and preferably multiple drawers in this embodiment. In the depicted example, slidable drawer 54 may comprise a handle panel 54A, drawer rails 54B and 54D, and a rail 56 for engaging with rails in storage compartment 64 of portable cooler 10.

Slidable drawer 54 may also include one or more retainers 54C and 54E for retaining items within slidable drawer 54. As shown in the embodiment in FIG. 3, retainers 54C and 54E may comprise a plurality of concave, semicircular walls, spaced apart from one another such that the contents of a beverage held in retainers 54C and 54E would be exposed along the underside and top to allow for improved cooling. Although retainers 54C and 54E as shown in FIG. 3 are adapted for retaining beverage cans, other retaining mechanisms for beverages or other storage media may be used.

Figure 5:
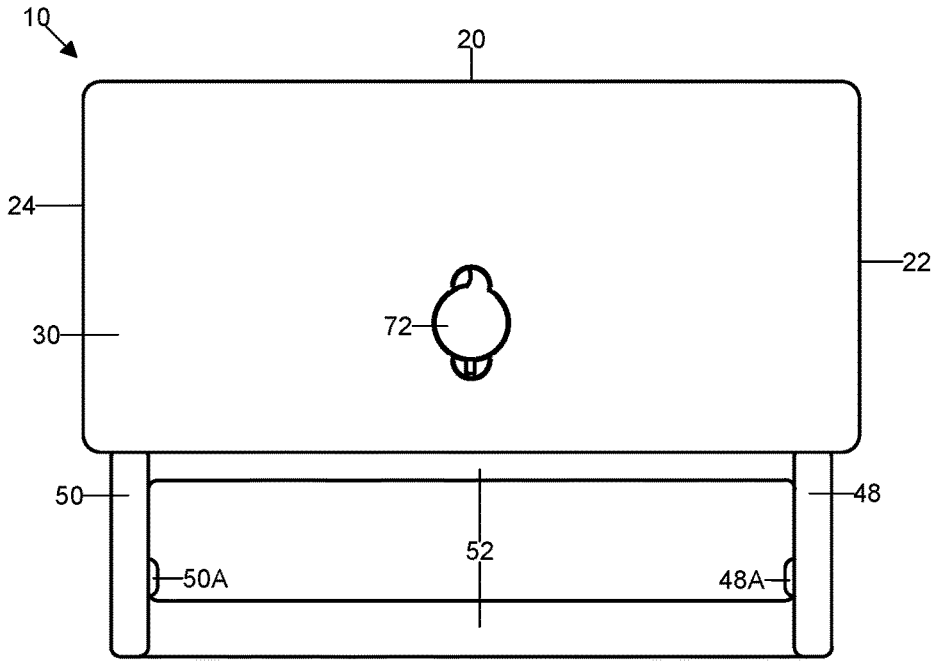
FIG. 5 depicts a rear view of an embodiment of portable cooler 10 with elevation panels 48 and 50 extended.
Figure 6:
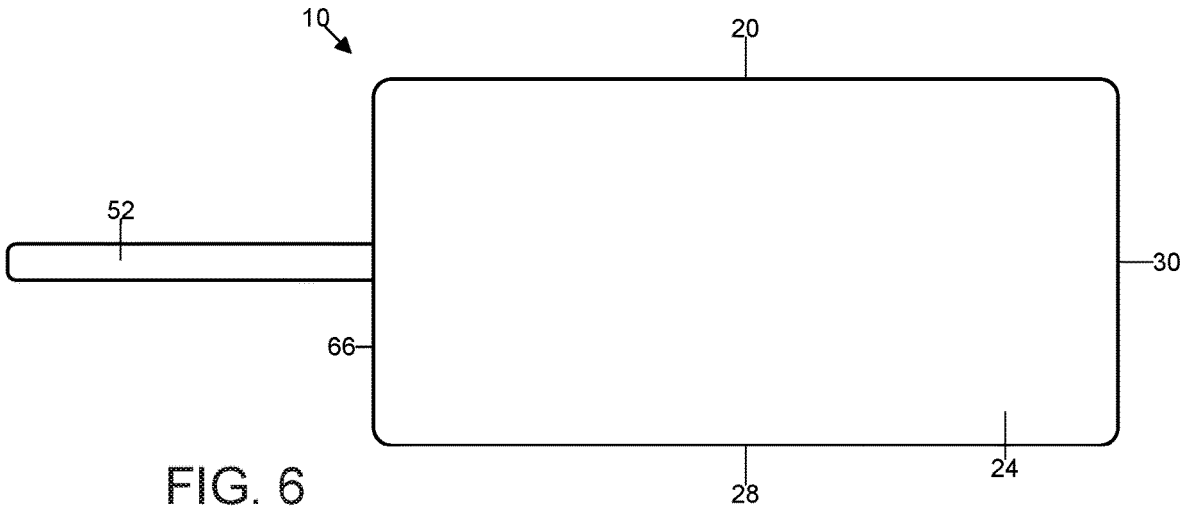
FIG. 6 shows a right side view of an embodiment of portable cooler 10 with carry handle 52 extended.
Figure 7:
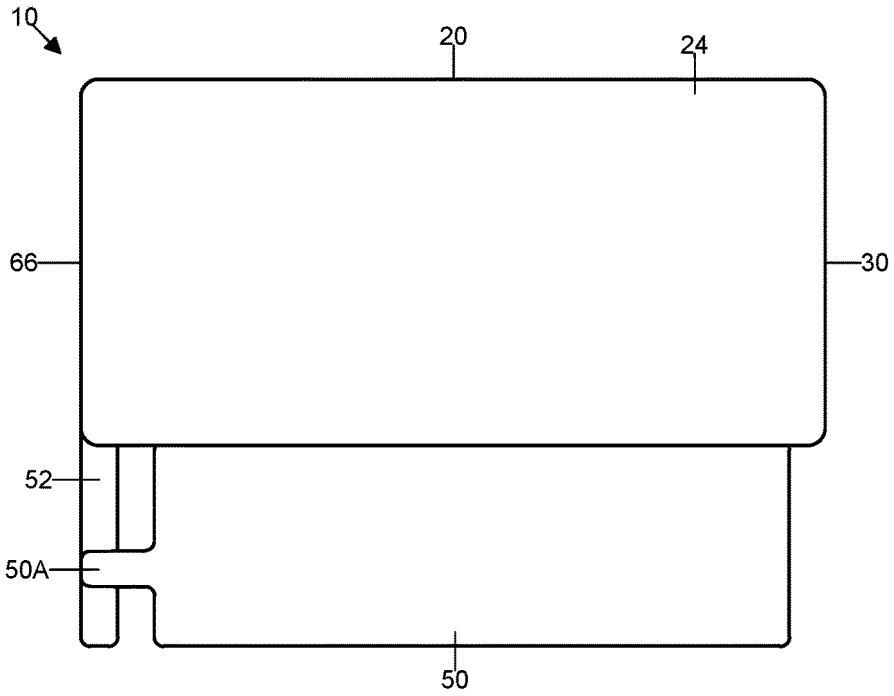
FIG. 7 shows a right side view of an embodiment of portable cooler 10 with carry handle 52 retracted and elevation panel 50 extended.

Referring to FIGS. 4-10, some embodiments of the portable cooler 10 include carry handle 52, which as shown in FIG. 5, can be retracted and locked in relationship with elevation panels 48 and 50, which extend relative to bottom panel 28. As further seen in FIG. 5, portable cooler 10 may comprise back panel 30, which in some embodiments may include water drain 72. FIG. 6 is a right side view of an embodiment of portable cooler 10 and depicts an embodiment of portable cooler 10 where carry handle 52 is in an extended position and may allow transporting of portable cooler 10 in, for example, an upright position. FIG. 7 is a right side view of an embodiment of portable cooler 10 with carry handle 52 retracted and elevation panel 50 extended. FIG. 8 shows a left side view of an embodiment of portable cooler 10 with carry handle 52 extended. FIG. 9 illustrates a left side view of an embodiment of portable cooler 10 with carry handle carry handle 52 retracted and elevation panel 48 extended.

Figure 10:
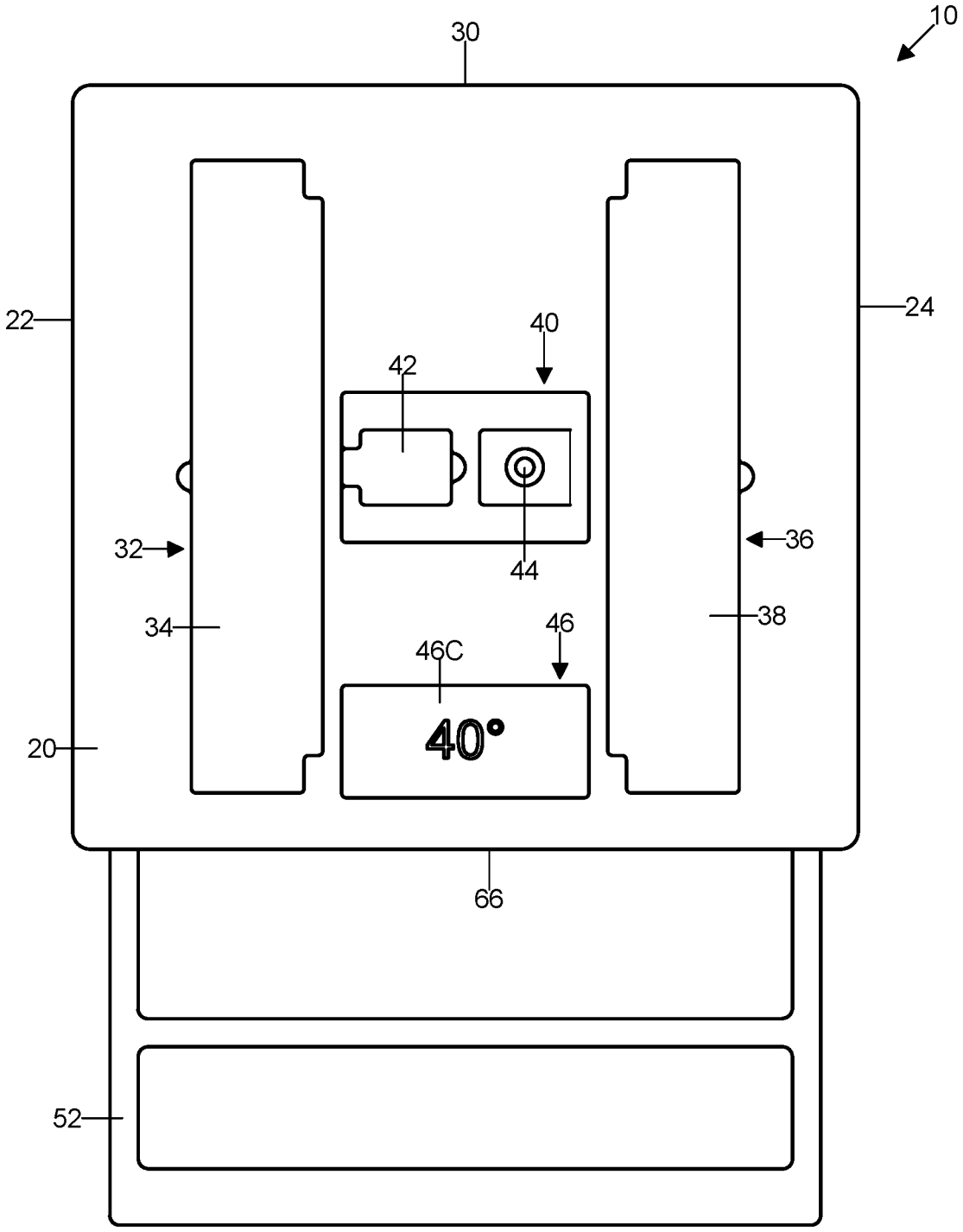
FIG. 10 illustrates a top view of an embodiment of portable cooler 10 with carry handle 52 extended.
Figure 11:
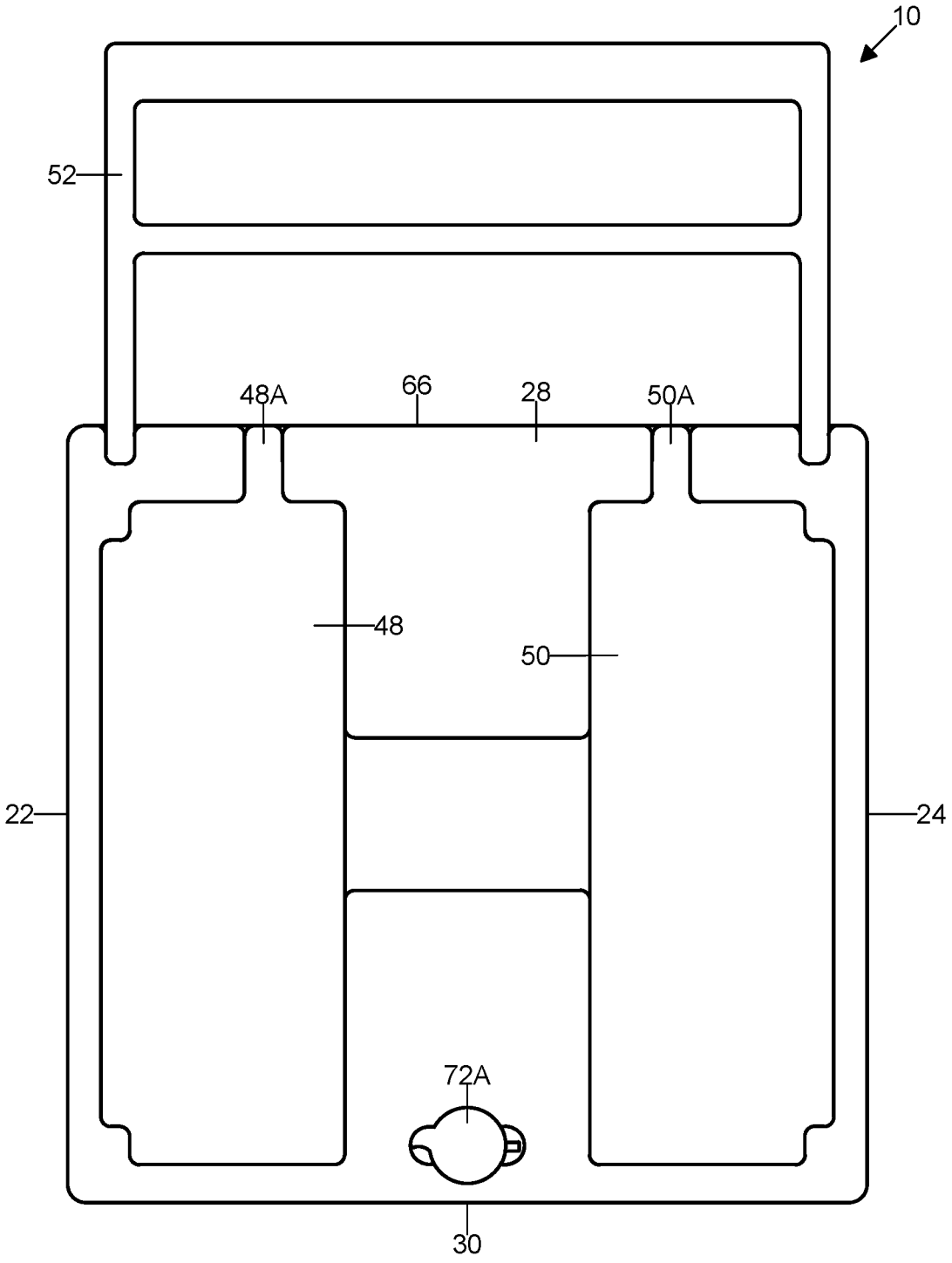
FIG. 11 depicts a bottom view of an embodiment of portable cooler 10 with carry handle 52 extended.

Referring now to FIGS. 10-11, the portable cooler 10 can be arranged so that the carry handle 52 is extended. Also as shown in this example, light module 40 is a self-contained unit, comprising battery compartment 42*m*, on/off switch 44, and one or more light sources, such as, for example, LEDs (not shown). The specific placement of lighting module 40 in FIG. 10 is one example for providing illumination to the interior of portable cooler, but other placements are contemplated, such as other locations on top panel 66, or in other panels of portable cooler 10. Alternative embodiments may also use separate components, rather than a self-contained unit for lighting module 40. As such, LEDs or any other type of suitable lighting source may be attached to an interior area within portable cooler 10. Likewise, battery compartment 42 and on/off switch 44 may be attached to another suitable interior or external portion of portable cooler 10. As depicted in FIG. 11, the portable cooler 10 may optionally include water drain 72A. As such, when using conventional ice, water may be selectively drained from portable cooler 10 after some or all of the ice is melted.

Figure 12:
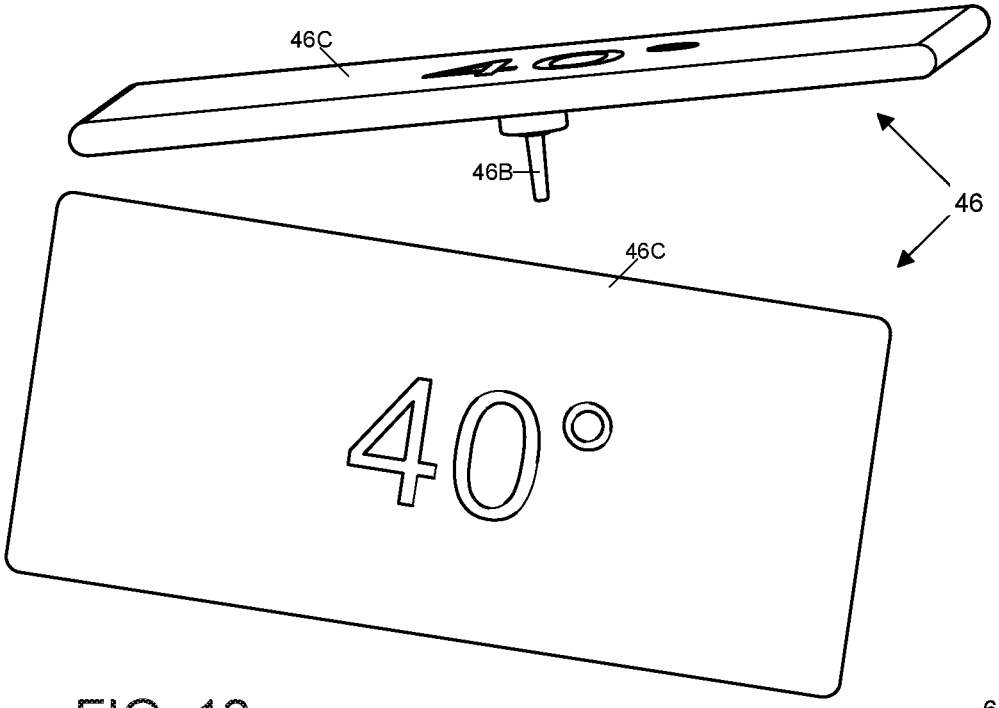
FIG. 12 shows an embodiment of temperature module 46.

Referring to FIGS. 10 and 12, in certain embodiments, portable cooler 10 may comprise a digital temperature display 46C for displaying an approximate internal temperature of storage cavities 64 and/or 64A, as measured by temperature probe 46B. In certain embodiments, portable cooler 10 may comprise a plurality of digital temperature displays, such as one for each of storage cavities 64 and 64A. Further, temperature module 46 may be attached to another suitable interior or external portion of portable cooler 10.

Figure 13:
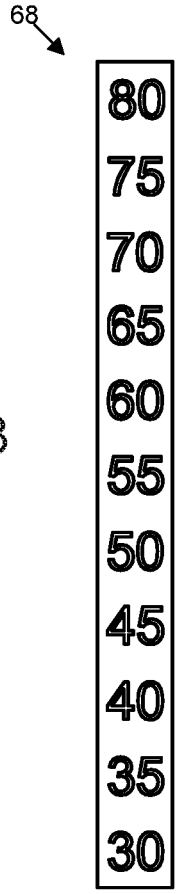
FIG. 13 depicts an embodiment of thermometer 68.

Referring now to FIG. 13, some embodiments of the portable cooler 10 can include a reversible liquid crystal temperature strip 68. The reversible temperature strip 68 of the type shown in FIG. 13 does not require a source of electrical power and may be adhesively fixed to surfaces of the portable cooler 10. For example, temperature strip 68 may be affixed to transparent layer 32A or 36A, for example, or both, to monitor the relative internal temperature of storage cavities 64 and/or 64A.

Figure 14:
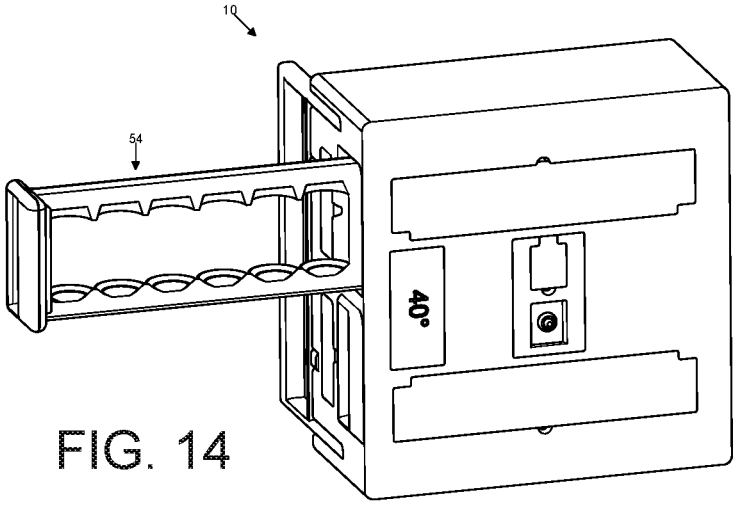
FIG. 14 is an isometric view of an embodiment of portable cooler 10 in a right horizontal orientation.
Figure 15:
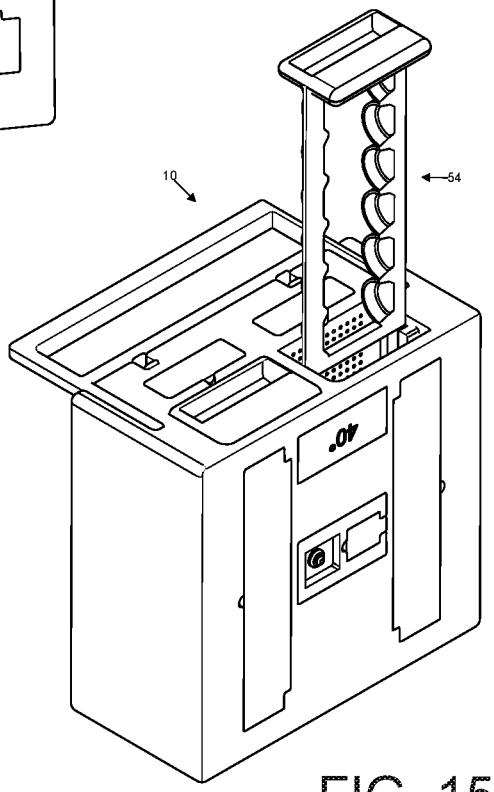
FIG. 15 is an isometric view of an embodiment of portable cooler 10 in a vertical orientation.
Figure 16:
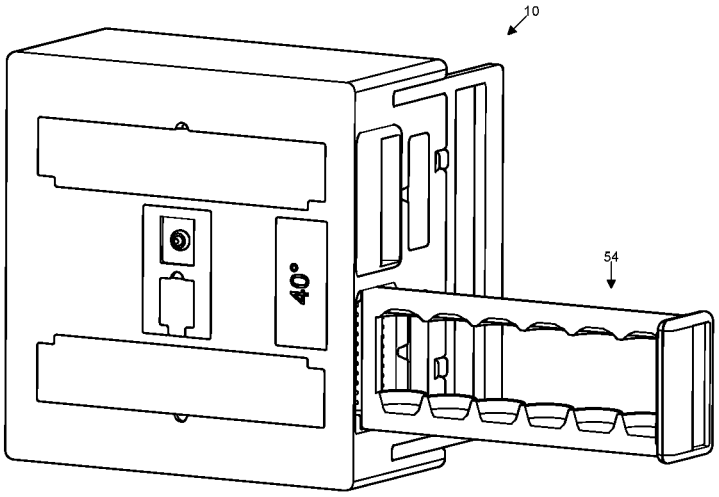
FIG. 16 is an isometric view of an embodiment of portable cooler 10 in a left horizontal orientation.

Referring now to FIGS. 14-16, the portable cooler 10 can be arranged so that a first slidable drawer 54 is in an extended position (while a second slidable drawer 54 is optionally retracted) to provide access to a drink carrier compartment. FIG. 14, for example, is an isometric view of an embodiment of portable cooler 10 in a right horizontal orientation with the first slidable drawer 54 extended and contemporaneously with the carry handle 52 retracted and locked in relationship with elevation panels 48 and 50. FIG. 15 is an isometric view of an embodiment of portable cooler 10 in a vertical orientation. FIG. 16 is an isometric view of an embodiment of portable cooler 10 in a left horizontal orientation.

A number of embodiments have been described. Nevertheless, it will be understood that various modifications may be made without departing from the scope of the following claims.

What is claimed is:

1. A portable cooler comprising:

a cooler body at least partially defined by a front wall, a rear wall, two side walls, a bottom, and a nonremovable lid that is rigidly fixed to the front wall, the rear wall, and the two side walls;

first and second drawer channels positioned side-by-side in the front wall and each of the first and second drawer channels defining respective guide rails extending in a longitudinally rearward direction toward the rear wall;

a first cooler drawer configured to slidably engage with the guide rails of the first drawer channel;

a second cooler drawer configured to slidably engage with the guide rails of the second drawer channel; and a cooler compartment positioned within the cooler body for containing at least one cooling element in thermal communication with at least one of the first and second cooler drawers.

2. The portable cooler of claim 1, further comprising an extendable carry handle.

3. The portable cooler of claim 2, wherein the extendable carry is moveable relative to the front wall.

4. The portable cooler of claim 2, further comprising a viewable temperature indicator in the nonremovable lid.

5. The portable cooler of claim 1, wherein the first and second guide rails extend substantially the entire distance from the front wall to the rear wall; and wherein the first and second cooler drawers are configured to slidably engage with substantially the entire length of the first and second guide rails.

6. The portable cooler of claim 5, wherein the semicircular receptacles comprise concave faces, and wherein the concave faces face upward toward the nonremovable lid.

7. The portable cooler of claim 1, wherein the first and second cooler drawers further comprise a plurality of beverage retainers; wherein said beverage retainers comprise semicircular receptacles.

8. The portable cooler of claim 1, further comprising a light within the cooler body; a first viewing aperture in the nonremovable lid for holding a transparent viewport for viewing the first cooler drawer; and a second viewing aperture in the nonremovable lid for holding a transparent viewport for viewing the second cooler drawer.

9. The portable cooler of claim 1 where the cooler compartment is located entirely below the first and cooler second drawers.

10. A method of cooling contents of a portable cooler, comprising:

placing a first item to be cooled into a first cooler drawer of the portable cooler having a cooler body at least partially defined by a front wall, a rear wall, two side walls, a bottom, and a nonremovable lid that is rigidly fixed to the front wall, the rear wall, and the two side walls;

sliding the first cooler drawer into a first closed position in a first drawer aperture in the front wall so that the first cooler drawer engages with a first set of guide rails extending in a longitudinally rearward direction away from the front wall and toward the rear wall contemporaneously while the nonremovable lid supports an external structure upon an upper face of the nonremovable lid;

placing a second item to be cooled into a second cooler drawer of the portable cooler;

sliding the second cooler drawer into a second closed position in a second drawer aperture side-by-side with the first drawer aperture in the front wall so that the second cooler drawer engages with a second set of guide rails extending in the longitudinally rearward direction away from the front wall and toward the rear wall contemporaneously while the nonremovable lid supports the external structure upon the upper face of the nonremovable lid, wherein the first and second set of guide rails extend substantially the entire distance from the front wall to the rear wall, and wherein the first and second cooler drawers are configured to slidably engage with substantially the entire length of the first and second sets of guide rails; and positioning the first item and the second item above at least one cooling element arranged within the cooler body contemporaneously while the nonremovable lid supports the external structure upon the upper face of the nonremovable lid.

11. The method of claim 10, further comprising an extending carry handle of the portable cooler relative to the front wall of the cooler body.

12. The method of claim 10, wherein the first and second cooler drawers further comprise a plurality of beverage retainers; wherein said beverage retainers comprise an array of semicircular receptacles.

13. The method of claim 12, wherein each of the semicircular receptacles comprises at least one concave face oriented upwardly toward the nonremovable lid.

14. The method of claim 10, further comprising viewing a temperature indicator mounted to the nonremovable lid.

15. The method of claim 10, wherein the portable cooler further comprises a light within the portable cooler; a first viewing aperture in the nonremovable lid for holding a transparent viewport for viewing the first cooler drawer; and a second viewing aperture in the nonremovable lid for holding a transparent viewport for viewing the second cooler drawer.

16. A method, comprising:

supporting an external structure upon an upper face of a lid of a portable cooler, the portable cooler having a cooler body at least partially defined by a front wall, a rear wall, two side walls, a bottom, and the lid; and during said supporting the external structure upon the upper face of the nonremovable lid, providing access to a removable item stored in a first slidable cooler drawer of a pair of side-by-side slidable cooler drawers located above at least one cooling element within the cooler body by withdrawing the first cooler drawer in a longitudinally forward direction away from the rear wall while the other of the slideable cooler drawers remains stationary relative to the rear wall.

17. The method of claim 16, wherein the lid of the portable cooler is a nonremovable lid that is joined with the front wall, the rear wall, and the two side walls.

18. The method of claim 17, wherein the portable cooler includes first and second drawer channels positioned side-by-side in the front wall, and each of the first and second drawer channels defines respective guide rails extending in a longitudinally rearward direction toward the rear wall so that the first slidable cooler drawer is slidable along the guide rails of the first drawer channel, and the other of the slideable cooler drawers is slidable along the guide rails of the second drawer channel.

19. The method of claim 18, exposing a view of the removable item stored in a first slidable cooler drawer through at least a first viewing window positioned within the nonremovable lid above the first drawer channel.

* * * * *